US006719680B2

(12) United States Patent
Hosoya et al.

(10) Patent No.: US 6,719,680 B2
(45) Date of Patent: Apr. 13, 2004

(54) SHEET FOLDING APPARATUS

(75) Inventors: Hisao Hosoya, Hachioji (JP); Hideyo Ohashi, Miyoshi-machi (JP); Kazuyoshi Omi, Kawagoe (JP); Masaru Goto, Tokyo (JP); Tomoki Nagaoka, Kodaira (JP); Kazuaki Fukuda, Kawagoe (JP); Masanobu Kawano, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/075,354

(22) Filed: Feb. 14, 2002

(65) Prior Publication Data

US 2002/0117793 A1 Aug. 29, 2002

(30) Foreign Application Priority Data

Feb. 26, 2001 (JP) ..... 2001-050100
Mar. 27, 2001 (JP) ..... 2001-090004
Mar. 27, 2001 (JP) ..... 2001-090005

(51) Int. Cl.[7] ..... B31F 1/08

(52) U.S. Cl. ..... 493/324; 495/424; 495/434; 495/435

(58) Field of Search ..... 493/324, 8, 23, 493/424, 434, 435, 442; 271/202, 245, 256, 270

(56) References Cited

U.S. PATENT DOCUMENTS 4,270,911 A * 6/1981 McNew ..... 493/410
4,519,601 A * 5/1985 Watanabe ..... 271/114
4,586,704 A * 5/1986 Lehmann et al. ..... 270/46
4,717,134 A * 1/1988 Iida et al. ..... 270/39.01
4,940,224 A * 7/1990 Couper ..... 271/263
4,986,525 A * 1/1991 Takagi et al. ..... 271/114
5,076,556 A * 12/1991 Mandel ..... 270/45
5,104,110 A * 4/1992 Haibara ..... 271/9.02
5,108,082 A * 4/1992 Shea et al. ..... 270/47
5,114,130 A * 5/1992 Hamanaka et al. ..... 270/58.11
5,342,037 A * 8/1994 Martin ..... 271/111
5,442,432 A * 8/1995 Tani ..... 399/410
5,514,066 A * 5/1996 Monaco ..... 493/25
5,536,001 A * 7/1996 Lange et al. ..... 271/202
5,655,765 A * 8/1997 Asami et al. ..... 271/185
5,769,774 A * 6/1998 Beck et al. ..... 493/421
5,820,122 A * 10/1998 Schneider ..... 271/188
5,851,009 A * 12/1998 Siebenmann ..... 271/270
5,944,645 A * 8/1999 Kobayashi ..... 493/16
5,993,369 A * 11/1999 Sekita et al. ..... 493/420
6,132,352 A * 10/2000 Rider ..... 493/419

* cited by examiner

*Primary Examiner*—Scott A. Smith
*Assistant Examiner*—Chukwurah Nathaniel
(74) *Attorney, Agent, or Firm*—Muserlian, Lucas and Mercanti

(57) ABSTRACT

A sheet folding apparatus having a Z-folding function which incluses a sheet conveyance device for conveying a paper sheet having an image formed thereon and a stopping member capable of moving for adjusting the position thereof provided in a conveyance path in order to stop a paper sheet conveyed by the sheet conveyance device at the leading edge colliding against the stopping member, and forms a fold by introducing the buckle portion of the paper sheet formed by the stopping member between a roller pair composed of two folding rollers and gripping by the rollers. The sheet folding apparatus is provided with a controller for temporarily reducing the rotating speed of each of the folding rollers, at a timing when the paper sheet is gripped between the roller pair.

12 Claims, 16 Drawing Sheets

FIG. 2 ( a )
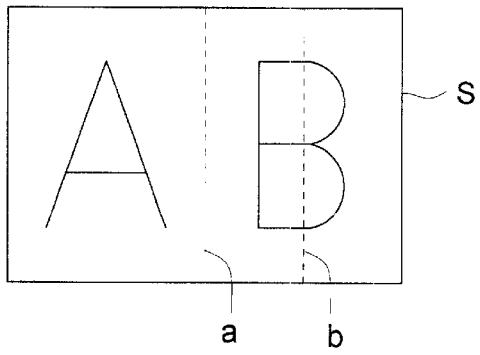
FIG. 2 ( b )
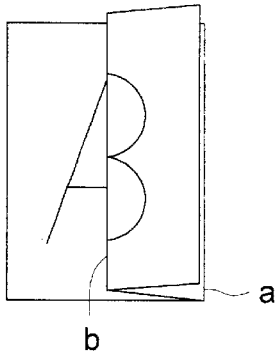
FIG. 2 ( c )
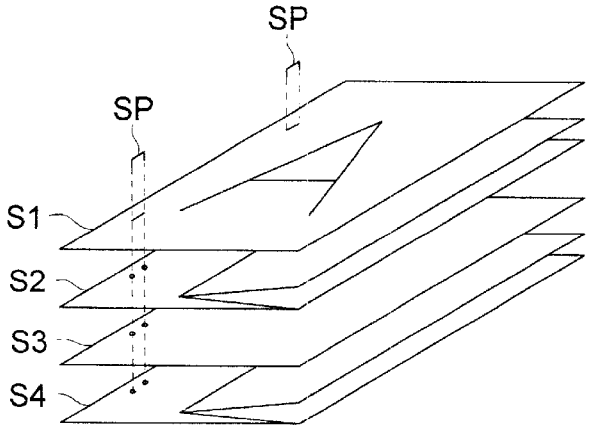

SHEET FOLDING APPARATUS

BACKGROUND OF THE INVENTION

This invention relates to a sheet folding apparatus of an image forming apparatus such as a copying machine, wherein driving force is controlled in accordance with the load increasing while a sheet folding roller in a folding mechanism folds a paper sheet having an image formed, in the case where it practices sheet folding such as folding in three (hereinafter referred to as a Z-folding).

Up to now, in a sheet folding mechanism for practicing a sheet folding process such as a Z-folding process, as disclosed in the Japanese publication Tokkaisho No. S61-248861, it has been put in practice to make twice-folding of a Z-fold type by a first-stage roller pair and a second-stage roller pair; however, because folding is not enough made by those roller pairs only, it has been put in practice that a roller for strengthening fold is pressed to one of the second-stage pair of rollers so as to secure a firm folding state certainly. This is done because the pressing force of each of the roller pairs cannot be strengthened in respect of the driving force, to make an insufficient fold line which is not acceptable for practical use, and in order to make up for it, a mechanism for strengthening a fold is added; this is not preferable because the apparatus is made larger-sized.

Further, in the Japanese publication No. Tokkaisho S61-248863, it is disclosed that, while paper sheet folding proceeds as a paper sheet is conveyed between a two rollers forming a roller pair, the folding rollers are rotated in the forward and reverse direction alternately to repeat the back-and-forth movement of a paper sheet in the path for making a fold plural times, to make a firm fold.

Further, also in the Japanese publication Tokkaisho No. S62-16987, it is disclosed that an insufficient and imperfect fold is compensated for by providing a mechanism for strengthening a fold after paper sheet folding is once finished by a pair of rollers.

However, the addition of a mechanism for strengthening a fold such as a roller for strengthening a fold, or the providing of a mechanism for practicing a repeating operation such as moving back and forth at the roller site of carrying out sheet folding, is not preferable because it makes the apparatus complicated and larger-sized by that. Further, if a repeating operation such as moving back and forth is practiced, it is produced the defect that the time required for one cycle of paper sheet folding becomes longer, which lowered the efficiency and makes the productivity worse.

Further, this invention relates to a sheet folding apparatus, wherein it is accomplished that a folding mechanism for practicing a sheet folding process such as a Z-folding process for a paper sheet having an image formed on it in an image forming apparatus such as a copying machine is simplified, a precise fold is obtained, there is posed no problem such as a paper jam, and a recovery processing can be done simply and certainly even though a paper jam occurs.

Up to now, as disclosed in the Japanese publications Jikkaisho No. S63-190254 and Tokkaihei No. H9-77360, it has been put in practice that, because a first-time folding path, a second-time folding path, and an ejecting path after twice-folding were independently and separately provided, a number of guide members such as guide plates making up a sheet conveyance path were arranged. Paper sheet paths in a sheet folding mechanism for practicing a sheet folding process such as a Z-folding process for a paper sheet having an image formed on it in an image forming apparatus such as a copying machine have had a complicated structure with paths corresponding to the respective roles formed separately in the above-mentioned way.

However, when it is posed a problem of a jam such that occurs in the folding path positioned inside among the three paper conveyance paths in the sheet folding apparatus, it is difficult to reach from the outside, and its releasing and recovery must be done by dismounting the outside conveyance paths, which takes time and is accompanied by considerable big difficulties.

Further, this invention relates to a sheet folding apparatus for practicing a sheet folding process and to an image forming apparatus provided with the sheet folding apparatus.

For a finisher of a copying machine or a printer, it is widely used an apparatus for applying a sheet folding process to a paper sheet having an image formed on it.

It is necessary that a sheet folding apparatus as such a finisher is small-sized because it is used in combination with an image forming apparatus mainframe, and on top of it, because an image forming apparatus forms an image on paper sheets of various sizes, it is required for the sheet folding apparatus to be capable of coping with various sizes of paper sheet.

In order to meet such a requirement, various kinds of sheet folding apparatus has been heretofore proposed. As regards a folding mechanism, it is mostly used such one that practices folding through giving a buckle to a paper sheet by moving it forward with its leading edge stopped and feeding the buckle portion between a pair of folding rollers, for the reason that the folding mechanism part can be made small-sized.

In such a sheet folding apparatus, for the purpose of coping with various sizes, a mechanism to displace the position of stopping member for stopping the leading edge of a paper sheet is employed.

For example, a mechanism having stopping members provided at plural positions and making these stopping members selectively come into or out of the paper conveyance path by means of a solenoid, a mechanism using a screw to displace a stopping member as shown in the Japanese publication Tokkaihei No. H10-194586, a mechanism moving a stopping member by means of a pinion and a rack, etc. have been disclosed.

However, a conventional sheet folding apparatus has been unsatisfactory because various restrictions were produced, that it became of high cost, that it was difficult to make small-sized, etc., for the reason that it must satisfy the conditions that the stopping member was capable of moving, that the whole of the apparatus was made small-sized, etc.

That is, a sheet folding apparatus using a plurality of stopping members became of high cost owing to the number of parts increasing; further, as regards one that displaces the stopping member by means of a screw, the moving velocity of the stopping member was slow owing to its being driven by a screw which made the switching of paper size take a longer time, and one using a rack and a pinion was difficult to make small-sized; each had both merits and demerits and was unsatisfactory.

SUMMARY OF THE INVENTION

It is the first object of this invention to provide a sheet folding apparatus which is made small-sized, capable of making a precise fold certainly, stabilized, and of a good efficiency by eliminating the above-mentioned disadvantage of the conventional technology.

It is the second object of this invention to provide a sheet folding apparatus having a structure that is easy to handle, simple, and hard to become out of order.

It is the third object of this invention to provide a sheet folding apparatus which can be made small-sized and is of low cost by solving the above-mentioned problems in a conventional sheet folding apparatus, in particular, in a sheet folding apparatus to be used as a finisher of an image forming apparatus, and an image forming apparatus provided with the above-mentioned sheet folding apparatus.

The first object can be accomplished by any one of the structures (1) to (5).

(1) A sheet folding apparatus which comprises a sheet conveyance means for conveying a paper sheet having an image formed on it and a stopping member capable of moving for adjusting its position provided in a conveyance path in order to stop a paper sheet conveyed by the sheet conveyance means at its leading edge colliding against the stopping member, and forms a fold by introducing the buckle portion of the paper sheet formed by the stopping member between a roller pair composed of two folding rollers and gripping it by the rollers, characterized by being provided with a control means for temporarily reducing the rotating speed of each of the folding rollers, at a timing when the paper sheet is gripped between the roller pair.

(2) A sheet folding apparatus which comprises a sheet conveyance means for conveying a paper sheet having an image formed on it and a stopping member capable of moving for adjusting its position provided in a conveyance path in order to stop a paper sheet conveyed by the sheet conveyance means at its leading edge colliding against the stopping member, and forms a fold by introducing the buckle portion of the paper sheet formed by the stopping member between a roller pair composed of two folding rollers and gripping it by the rollers, characterized by being provided with a control means for temporarily reducing the rotating speed of each of the folding rollers, by switching a speed reducing mechanism directly coupled to a motor by a clutch with the number of revolutions per minute of the motor kept constant, at a timing when the paper sheet is gripped between the roller pair.

(3) A sheet folding apparatus which comprises a sheet conveyance means for conveying a paper sheet having an image formed on it and a stopping member capable of moving for adjusting its position provided in a conveyance path in order to stop a paper sheet conveyed by the sheet conveyance means at its leading edge colliding against the stopping member, and forms a fold by introducing the buckle portion of the paper sheet formed by the stopping member between a roller pair composed of two folding rollers and gripping it by the rollers, characterized by being provided with a control means for temporarily increasing the drive current of a direct-current motor as a drive means for each of the folding rollers, at a timing when the paper sheet is gripped between the roller pair.

(4) A sheet folding apparatus which comprises a sheet conveyance means for conveying a paper sheet having an image formed on it and a stopping member capable of moving for adjusting its position provided in a conveyance path in order to stop a paper sheet conveyed by the sheet conveyance means at its leading edge colliding against the stopping member, and forms a fold by introducing the buckle portion of the paper sheet formed by the stopping member between a roller pair composed of two folding rollers and gripping it by the rollers, characterized by being provided with a control means for temporarily increasing the pulse rate of a pulse motor as a drive means for each of the folding rollers, at a timing when the paper sheet is gripped between the roller pair.

(5) A sheet folding apparatus which comprises a sheet conveyance means for conveying a paper sheet having an image formed on it and a stopping member capable of moving for adjusting its position provided in a conveyance path in order to stop a paper sheet conveyed by the sheet conveyance means at its leading edge colliding against the stopping member, and forms a fold by introducing the buckle portion of the paper sheet formed by the stopping member between a roller pair composed of two folding rollers and gripping it by the rollers, characterized by being provided with a control means for temporarily changing the driving electric power of a drive means for each of the folding rollers from a stationary value to another stationary value higher than that, at a timing when the paper sheet is gripped between the roller pair.

The second object can be accomplished by the following structure (6) or (7).

(6) A sheet folding apparatus which comprises a sheet conveyance means for conveying a paper sheet having an image formed on it and a stopping member capable of moving for adjusting its position provided in a conveyance path in order to stop a paper sheet conveyed by the sheet conveyance means at its leading edge hitting the stopping member, and forms a fold by introducing the buckle portion of the paper sheet formed by the stopping member between a roller pair composed of two folding rollers and gripping it by the rollers, characterized in that, in the folding apparatus, a sheet conveyance path in a part for making up the leading edge portion of the paper sheet for the final folding of the Z-folding and a sheet ejection path for the paper sheet having been finally folded are made one and the same.

(7) A sheet folding apparatus which comprises a sheet conveyance means for conveying a paper sheet having an image formed on it and a stopping member capable of moving for adjusting its position provided in a conveyance path in order to stop a paper sheet conveyed by the sheet conveyance means at its leading edge colliding against the stopping member, and forms a fold by introducing the buckle portion of the paper sheet formed by the stopping member between a roller pair composed of two folding rollers and gripping it by the rollers, characterized in that, in the folding apparatus, there are provided a detecting means for detecting whether a paper sheet is moving forward or backward between a paper conveyance path in a part for making up the leading edge portion of the paper sheet for the final folding of the Z-folding and the roller pair by which the paper sheet is finally folded, and a control means for ejecting the paper sheet having been finally folded by retracting the stopping member in the folding path on the basis of the detection information of the detecting means.

In the above, "the leading edge portion for the final folding of the Z-folding" means the fold portion before the final one (the fold "b" to be described later), which becomes the leading edge portion playing a role to determine the position of the final fold (the fold "a" to be described later) where the final folding is to be done.

The above-mentioned third object of this invention can be accomplished by any one of structures (8) to (16) described below.

(8) A sheet folding apparatus comprising a first conveyance means, a stopping member for stopping the leading edge of a paper sheet conveyed by the first conveyance means, and a second conveyance means for gripping to convey the buckle portion of a paper sheet which have been buckled by being conveyed by the first conveyance means with its leading edged stopped by the stopping member, characterized by further comprising a toothed belt for supporting the stopping member and a belt moving means for moving the toothed belt, wherein the belt moving means makes the stopping member stop at a position selected out of a plurality of specified positions.

(9) A sheet folding apparatus as set forth in the above-mentioned structure (8), characterized in that the toothed belt is made up of an endless belt.

(10) A sheet folding apparatus as set forth in the above-mentioned structure (8) or (9), characterized in that the belt moving means is made up of a stepping motor.

(11) A sheet folding apparatus as set forth in any one of the above-mentioned structures (8) to (10), characterized by further comprising two sheet folding portions each comprising the aforesaid stopping member, the aforesaid toothed belt, and the aforesaid belt moving means.

(12) A sheet folding apparatus as set forth in any one of the above-mentioned structures (8) to (11), characterized in that the aforesaid belt moving means moves the aforesaid stopping member to a retraction position.

(13) An image forming apparatus characterized by comprising a first finisher having a sheet folding apparatus as set forth in any one of the above-mentioned structures (8) to (12) and an image forming section for forming an image on a paper sheet and conveying the paper sheet to the first finisher.

(14) An image forming apparatus as set forth in the above-mentioned structure (13), characterized by further comprising a second finisher, wherein a paper sheet having been conveyed from the aforesaid first finisher is processed in the second finisher.

(15) An image forming apparatus as set forth in the above-mentioned structure (13) or (14), characterized in that the aforesaid first finisher comprises a punching means.

(16) An image forming apparatus as set forth in the above-mentioned structure (14) or (15), characterized in that the aforesaid second finisher comprises a stapler.

BRIEF DESCRIPTION OF THE DRAWINGS

FIG. 2(*a*) is the plan of a paper sheet before Z-fold processing,

FIG. 2(*b*) is the plan of a paper sheet after Z-fold processing , and

FIG. 2(*c*) is a perspective view of a bundle of paper sheet in a state having been subjected to Z-fold processing and further to be subjected to bind processing;

DETAILED DESCRIPTION OF THE PREFERRED EMBODIMENT

In the following, a sheet folding apparatus for accomplishing the first and second objects of this invention, a sheet finisher after sheet folding by said sheet folding apparatus, and an image forming apparatus mainframe to which the above-mentioned apparatus are connected will be explained on the basis of the drawings.

Figure 1:
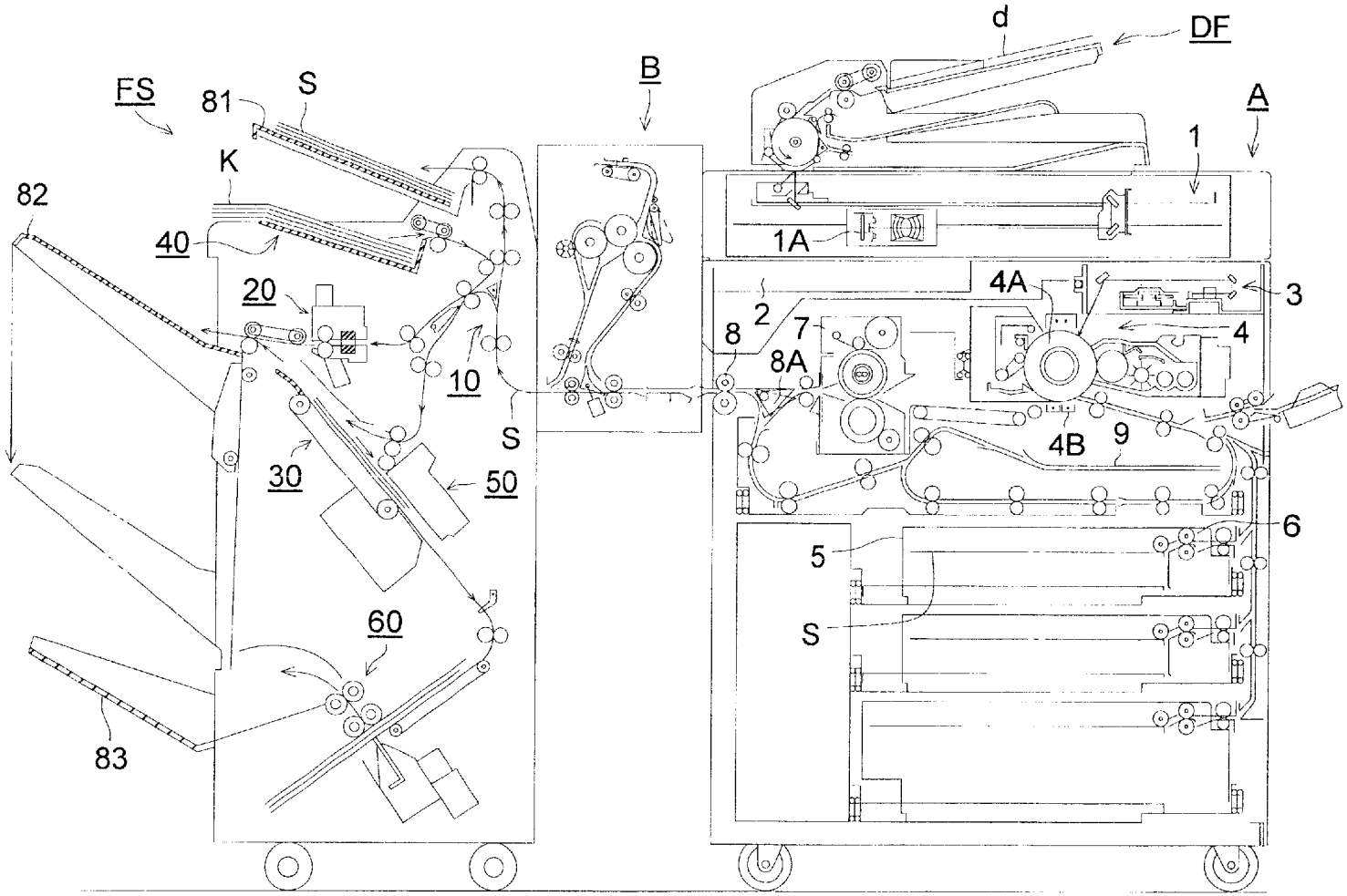
FIG. 1 is a drawing showing the overall structure of an image forming apparatus equipped with an image forming apparatus mainframe, a sheet Z-folding apparatus, a sheet finisher, and an automatic document feeder.

FIG. 1 is a drawing showing the overall structure of an image forming apparatus equipped with an image forming apparatus mainframe A, a sheet Z-folding apparatus B, a sheet finisher FS, and an automatic document feeder DF.

The image forming apparatus mainframe A shown in the drawing is equipped with an image reading section 1, an image processing section 2, an image writing section 3, an image forming section 4, a cassette paper feed section 5, a large capacity paper feed section (LCT) 6, a fixing device 7, a paper ejection section 8, an automatic duplex paper feed section (ADU) 9.

On the upper side of the image apparatus mainframe A, the automatic document feeder DF is installed. To the left side of the image forming apparatus mainframe A, that is, to the side near the paper ejection section 8, the sheet Z-folding apparatus B and the sheet finisher FS are coupled.

A document sheet d, which is placed on the document table of the automatic document feeder DF, is conveyed in the direction of the arrow mark, and the image on one or both sides of the document sheet is projected by an optical system in the image reading section 1, to be read by a CCD image sensor 1A.

The analogue signal, which has been obtained through the photoelectric conversion by the CCD image sensor 1A, is subjected to analogue processing, A/D conversion, shading correction, image compression processing, etc. in the image processing section 2, and then, is transmitted to the image writing section 3.

In the image writing section 3, an outputted light beam from a diode laser irradiates the photoreceptor drum in the image forming section 4, to form a latent image. In the image forming section 4, processes such as charging, exposure, development, transfer, separation, and cleaning are carried out, and an image is transferred onto a paper sheet S, which has been conveyed from the cassette paper feed section 5 or from the large capacity paper feed section 6. The paper sheet S carrying an image on it has its image fixed by the fixing device 7, and fed from the paper ejection section 8 into the sheet Z-folding apparatus B or into the sheet finisher FS directly. In another way, the paper sheet S, which has been fed into the automatic duplex paper feed section 9 by a conveyance path switching plate 8A with its image on one side already processed, has its image on the other side processed again in the image forming section 4, and then, is fed from the paper ejection section 8 into the sheet Z-folding apparatus B.

The sheet Z-folding apparatus B, by means of a plurality of folding rollers, folds twice the paper sheets S to bring each of them into a Z-shaped state, to form a stack of sheets as shown in FIG. 2(*a*) to FIG. 2(*c*).

FIG. 2(*a*) is the plan of a paper sheet S before Z-fold processing. The lines "a" and "b", which are shown as broken lines, are fold lines to be formed.

FIG. 2(*b*) is the plan of a paper sheet S after Z-fold processing. The paper sheet S, which has been subjected to Z-fold processing by a plurality of folding rollers of the sheet folding apparatus B, has fold lines "a" and "b" formed and is fold up.

FIG. 2(*c*) is a perspective view showing a bundle of paper sheets in a state where they have been subjected to Z-fold processing and will be further subjected to bind processing. It is shown a state where paper sheets S, which have been subjected to Z-fold processing, are conveyed into the sheet finisher FS to be described later, and are formed to become a booklet with staples SP stapled into them at the end portion by a binding means 50.

In the sheet finisher FS shown in FIG. 1, there are arranged in a line approximately in the vertical direction, from the top of the drawing, a fixed exit paper tray 81, in which sheets which have not been subjected to fold processing by the sheet folding apparatus B and are conveyed through the switching path under the sheet Z-folding apparatus of this invention are stacked, or sheets which are in the state of being just Z-folded by the sheet folding apparatus B, that is, in the state of having been not edited and bound yet are stacked, a cover sheet feed means 40 to be used in the case where sheets are edited to become a booklet, a shift processing conveyance section (large-capacity ejection conveyance section) 20, a first stacking section 30, the binding means 50, and a two-folding means 60.

In the right side part of the sheet finisher FS shown in the drawing, an entrance conveyance section 10 is arranged. Further, at the left-side surface of the sheet finisher FS shown in the drawing, there are arranged a moving up-and-down ejection tray 82 for stacking paper sheets after end binding and shift processing, and a fixed ejection tray for stacking paper sheets after center binding and two-fold processing.

Figure 3:
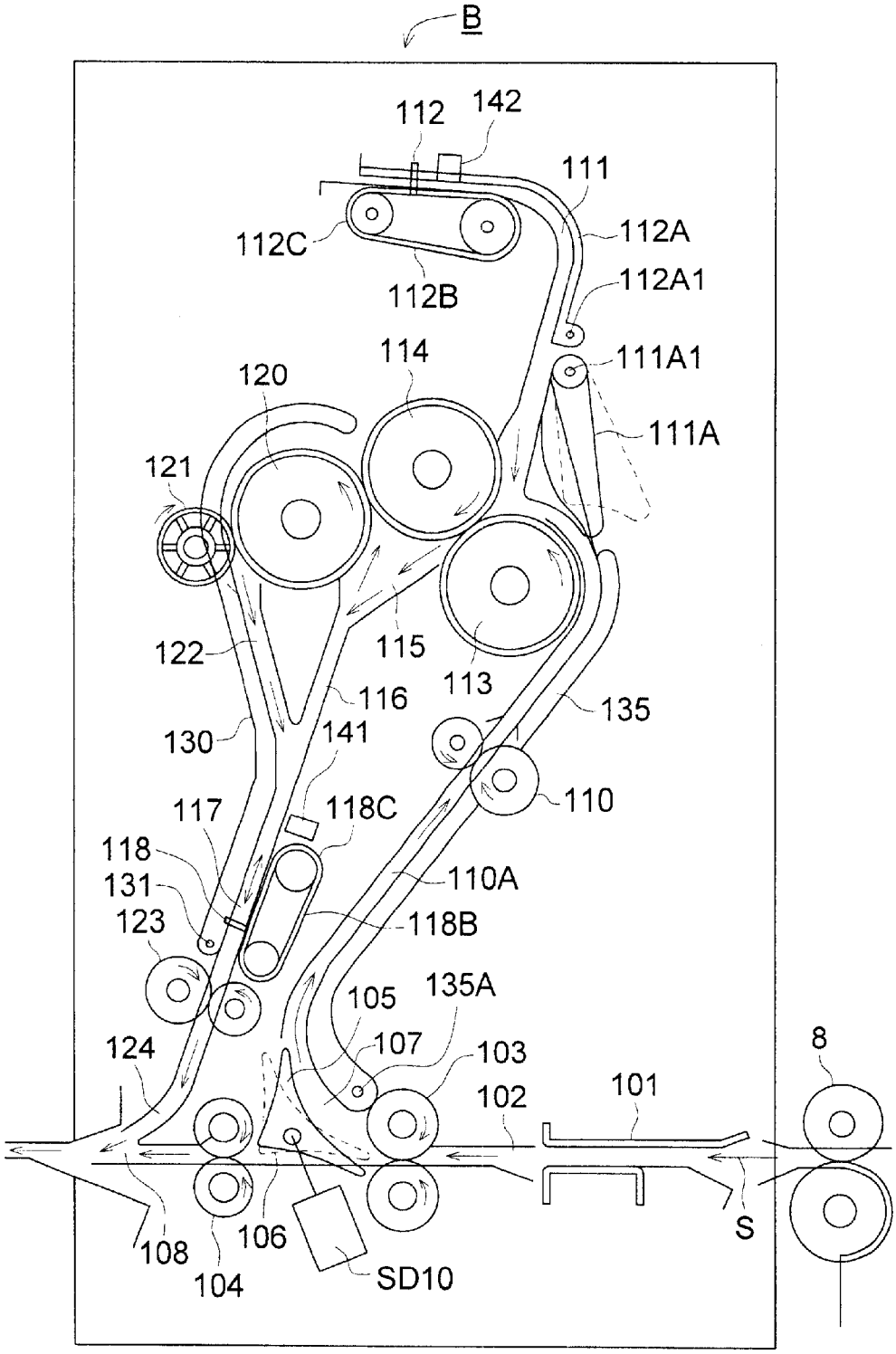
FIG. 3 is a cross-sectional view showing a sheet conveyance path of a sheet Z-folding apparatus as an example of the embodiment of a sheet folding apparatus of this invention.

FIG. 3 is a cross-sectional view showing a sheet conveyance path of the sheet folding apparatus B representing an example of the embodiment of a sheet folding apparatus of this invention.

A paper sheet S, which has been ejected from the paper ejection section 8 of the image forming apparatus mainframe A after image forming processing, in the case where sheet folding operation is not to be practiced, is introduced into an entrance portion 101, passes a sheet conveyance path 102, is conveyed by conveyance roller pairs 103 and 104, and is ejected to the sheet after processing apparatus FS outside the sheet folding apparatus B.

In this sheet conveyance process, a switching means 105 is kept at a position shown by the broken line in the drawing in the state of a solenoid SD10 being off, to open a sheet conveyance path 106, to bring a sheet conveyance path 107 in a closed state, and a paper sheet S can be ejected to the sheet finisher FS through a sheet conveyance path 108.

When a sheet Z-folding mode is set, the switching means 105 is oscillated by the driving of the solenoid SD10, and is kept at the position shown by the solid line in the drawing, to close the sheet conveyance path 106, to bring the sheet conveyance path 107 into an open state, which makes it possible to convey a paper sheet S to the roller pair composed of the folding rollers 113 and 114 for Z-folding a paper sheet S.

Figure 4:
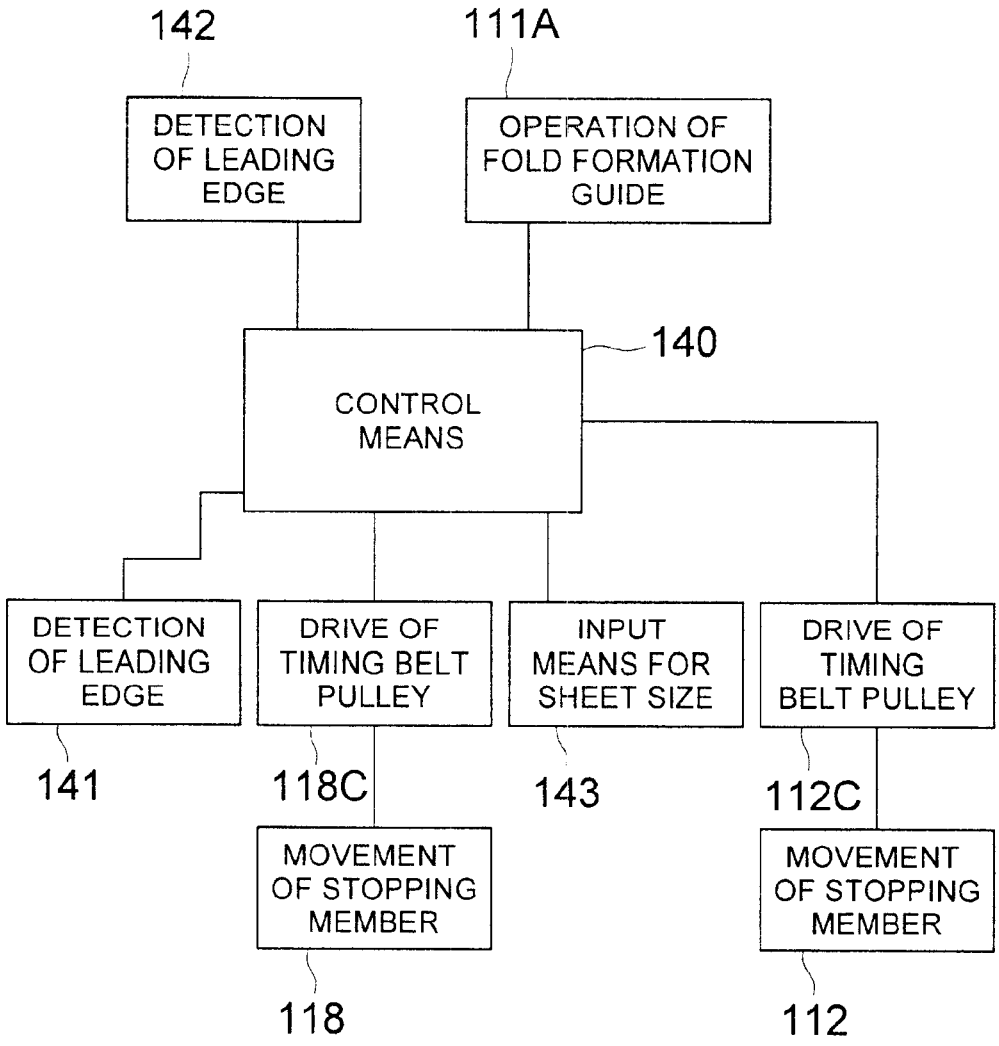
FIG. 4 is a block diagram of a control means for controlling the length of sheet folding, the stopping of conveyance of a paper sheet, and the switching of conveyance paths in a sheet folding apparatus of this invention.

The paper sheet S, which has passed the sheet conveyance path 107, is conveyed by a pair of conveyance rollers 110, is introduced into a sheet conveyance path 111 to move upward, and its proceeding is hindered by its leading edge portion colliding against a first stopping member 112; as shown by the block diagram in FIG. 4, it is detected by a leading edge detecting device 142 provided in the neighborhood of the first stopping member 112, while the middle portion of the paper sheet S, which continues conveyance, forms a buckle so as to make it easy to carry out sheet folding by the rotary shift of a fold forming guide 111A from the position shown by the broken line to the position shown by the solid line around a supporting point 111A1, and then, it is gripped by a pair of folding rollers 113 and 114 which are driven to rotate by a drive source as being pressed to each other, to form the fold line "b".

The paper sheet S, which has been subjected to fold processing based on the fold line b, passes conveyance paths 115, 116, and 117, with its fold line "b" made the leading edge of the sheet, and its proceeding is hindered by colliding against a stopping member 118 as a second stopping member, while the middle portion of the paper sheet S, which continues conveyance, forms a buckle, and then, it is gripped by a pair of folding rollers 114 and 120 which are driven to rotate by a drive source as being pressed to each other, to form the central fold line "a".

Besides, the above-mentioned stopping member 112 for stopping the leading edge portion of a paper sheet, and the above-mentioned stopping member 118 for stopping the leading edge portion which is formed of the first fold line "b" of a paper sheet are movable in accordance with the length of a paper sheet S in the conveyance direction, to form the desired fold lines "a" and "b".

The paper sheet S, which has been subjected to Z-fold processing to form the fold lines a and b, is conveyed by being gripped by the folding roller 120 and a roller 121 driven by it, and enters the sheet conveyance path 117 again through a sheet conveyance path 122. The above-mentioned stopping member 118 is kept in the state of its being retracted from the sheet conveyance path 117; therefore, the paper sheet S passes the position which was occupied by said stopping member 118, is conveyed by a pair of conveyance rollers 123, and is ejected from a sheet conveyance path 124 to the outside of the apparatus.

In the embodiment of this invention, the paper sheet S is to be ejected to the above-mentioned sheet finisher FS.

The above-mentioned stopping members 112 and 118 are respectively mounted, as attachments, on endless timing belts 112B and 118B, which are stretched around pulleys 112C and 118C respectively to be driven, and as shown in the block diagram of FIG. 4, are to be adjusted for their respective stopping positions by a sheet size inputting means 143; further, on top of the above-mentioned function, particularly as regards the stopping member 118, it is made to be deviated from the conveyance path to open it by a large amount of rotary movement of the pulley 118C, when the stopping member 118 must be retracted to let a paper sheet S pass.

Further, the above-mentioned retraction and movement to a specified position of the stopping member 118, as shown in the block diagram of FIG. 4, is carried out by a control means 140, which makes the pulley 118 operate by a detection signal obtained by detecting the position of the leading edge (fold line "b") of a paper sheet moving forward or backward by means of a sheet detecting sensor 141, which is placed opposite to the sheet conveyance path 117 near the timing belt 118B entrained about the pulley 118C.

Figure 5:
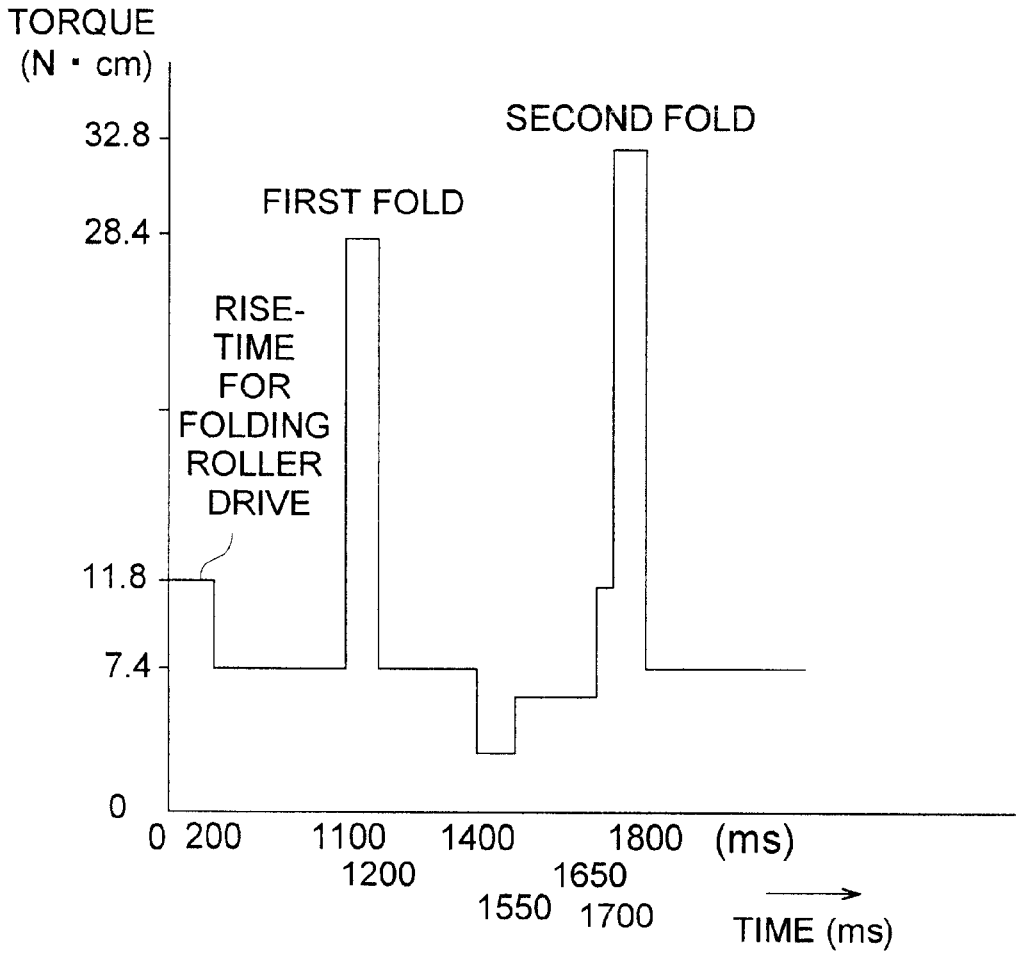
FIG. 5 is a graph showing how the torque load varies during a sheet folding cycle beginning with the actuating in a sheet folding apparatus.

Incidentally, as can be seen in FIG. 5, which is a graph showing how the torque load varies during a sheet folding cycle beginning with the actuation in a sheet folding apparatus, it is understood that the torque during the passage of a paper sheet between each roller pair at the times of the first folding and the second folding is 3.5 to 4.0 times the torque during no sheet folding at a low load (2.4 to 2.8 times the torque at the time of actuating). To each of the above-mentioned roller pairs during sheet folding, because two sheets piled in the first folding or three sheets piled in the second folding are conveyed, the above-mentioned large torque is given.

In order to cope with such a variation of load, it is possible to take such a countermeasure as to make larger the capacity of the drive motor for each of the aforesaid roller pairs. However, in the same way as the above-mentioned measure in the conventional technology, it is not preferable because it results in the overall apparatus being made larger-sized owing to the electric power source and the motor becoming larger-sized.

In this invention, in order to cope with such an actual situation, several concrete means as described below have been attempted.

Figure 6:
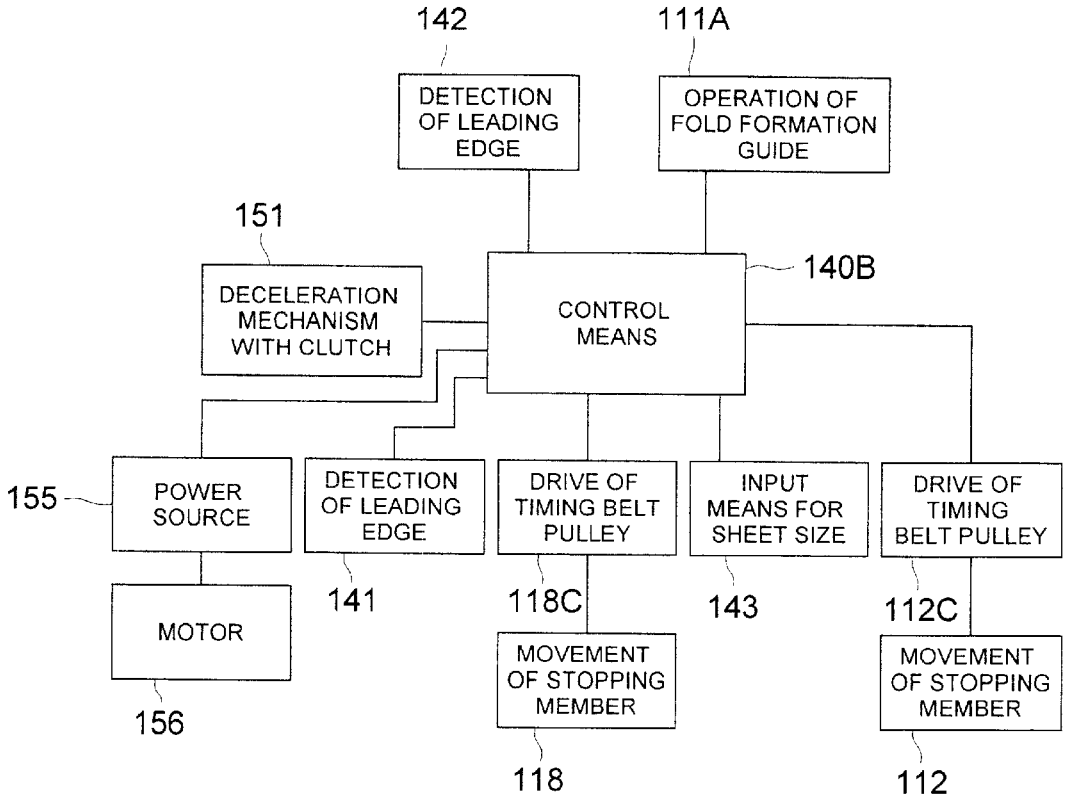
FIG. 6 is a block diagram of a control means composed of the control means shown in FIG. 4 with a control means for compensating for the load during a sheet folding process added.

The first means is such that the sheet folding apparatus B is operated at a constant rated number of revolutions by an electric power source 155 and a motor 156 operating at a normal rated current and voltage, and during the formation of the fold line "b" in the first folding by means of the roller pair composed of the folding rollers 113 and 114, and during the formation of the fold line "a" in the second folding by means of the roller pair composed of folding rollers 114 and 120, the rotating speed of each of the folding rollers is reduced to a lower speed than a normal one. To state it more concretely, for example, a speed reducing mechanism 151 in which switching is done by a simple gear train is provided. Further, it is provided, as shown in the block diagram of FIG. 6, a control means 140B for practicing such a control that, by detecting the timings when the leading edge of a paper sheet passes the above-mentioned roller pairs respectively by the sheet detecting sensors 141 and 142, said speed reducing mechanism 151 is switched by a clutch operation at each of these timings of detection signal to obtain firm and stable fold lines "a" and "b".

Further, by making a first-stage speed reducing change in the first folding, and a second-stage speed reducing change of higher reduction ratio in the second folding, it is possible to easily accomplish that the motor operates at the required torque of 2.4 to 2.8 times (3.5 to 4.0 times the normal one) the actuating torque for each of the folding rollers.

Figure 7:
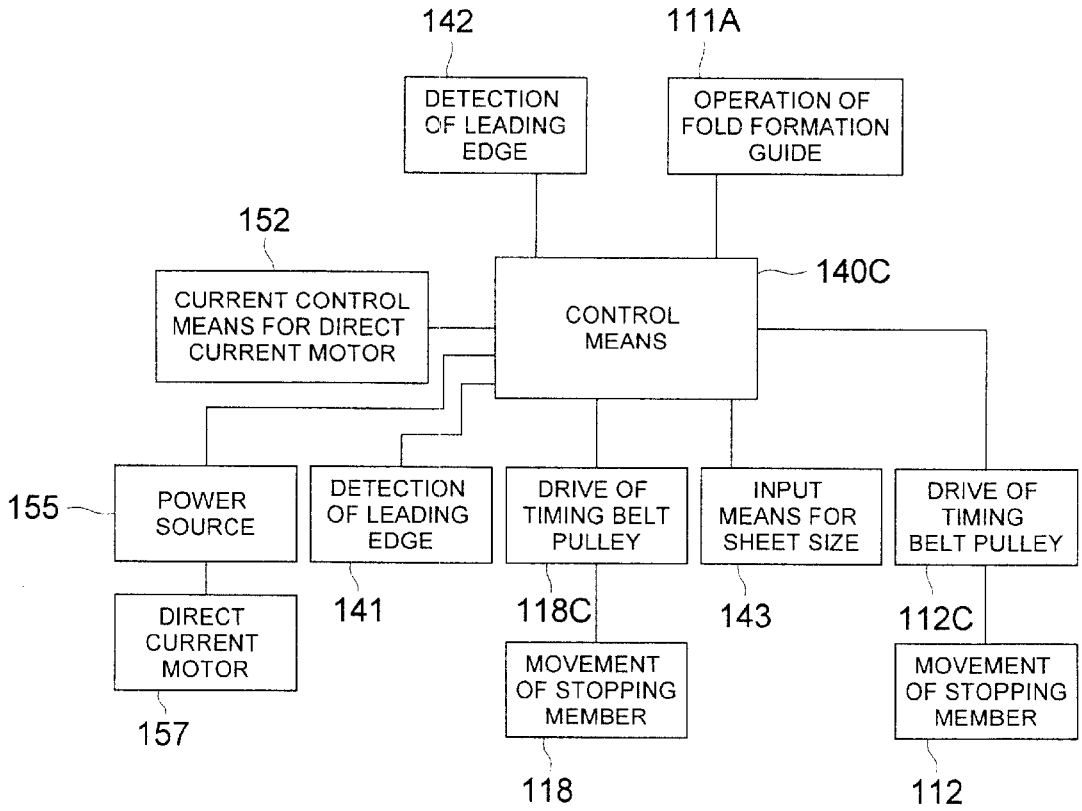
FIG. 7 is another block diagram of a control means composed of the control means shown in FIG. 4 with a control means for compensating for the load during a sheet folding process added.
Figure 10:
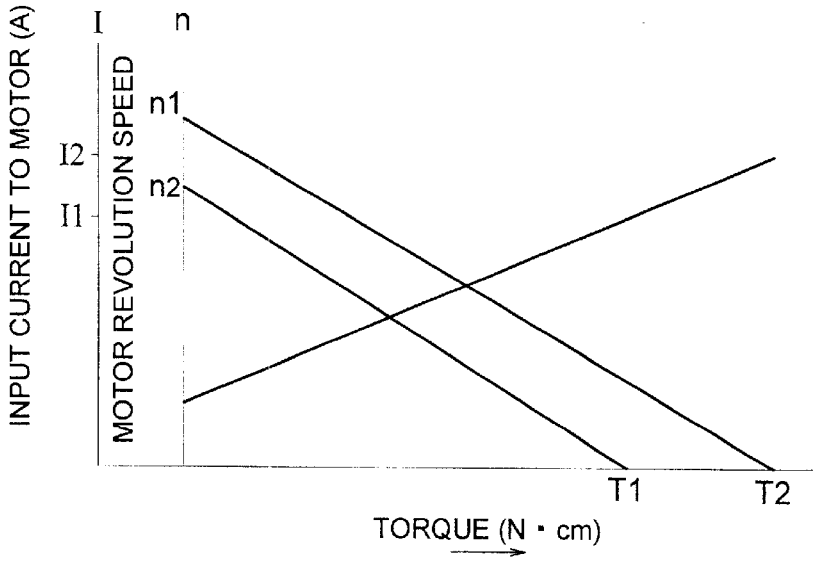
FIG. 10 is a graph showing the relation between the number of revolutions of a direct-current motor and its torque.

In the second means, the sheet folding apparatus B is operated at a normal rated electric voltage, using an electric power source 155 and a motor 156 both having a usual size. It is provided, as shown in the block diagram of FIG. 7, a control means 140C for practicing such a control that, during the formation of the fold line "b" in the first folding by means of the roller pair composed of the folding rollers 113 and 114, and during the formation of the fold line "a" in the second folding by means of the roller pair composed of folding rollers 114 and 120, as shown in a graph representing the relation between the number of revolutions and the torque, and the relation between the electric current and the torque of FIG. 10, by detecting the timings when the leading edge of a paper sheet passes the above-mentioned roller pairs respectively by the sheet detecting sensors 141 and 142, the electric current value of the direct-current motor is increased from a normal value $I_1$ at the starting and in other normal period to a value $I_2$ by means of a current changing means 152 at each of these timings of detection signal to raise the maximum torque value from $T_1$ to $T_2$, to obtain firm and stable fold lines "a" and "b".

Figure 8:
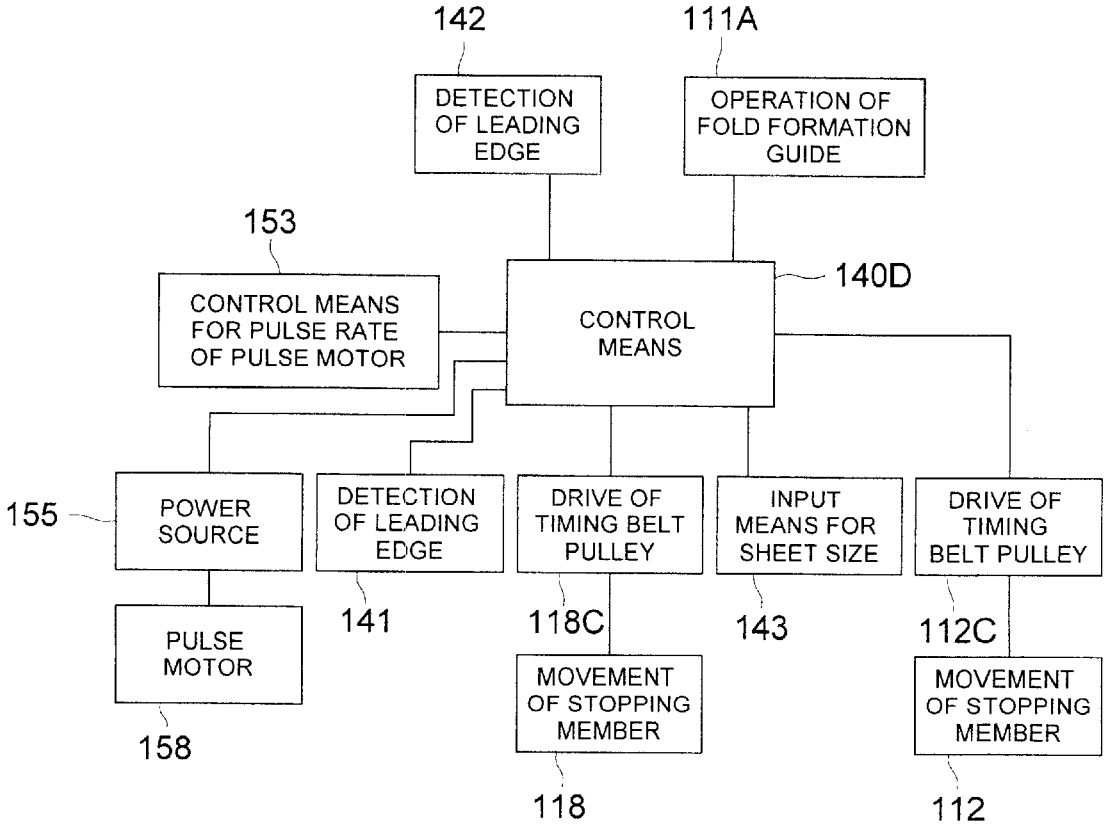
FIG. 8 is another block diagram of a control means composed of the control means shown in FIG. 4 with a control means for compensating for the load during a sheet folding process added.
Figure 11:
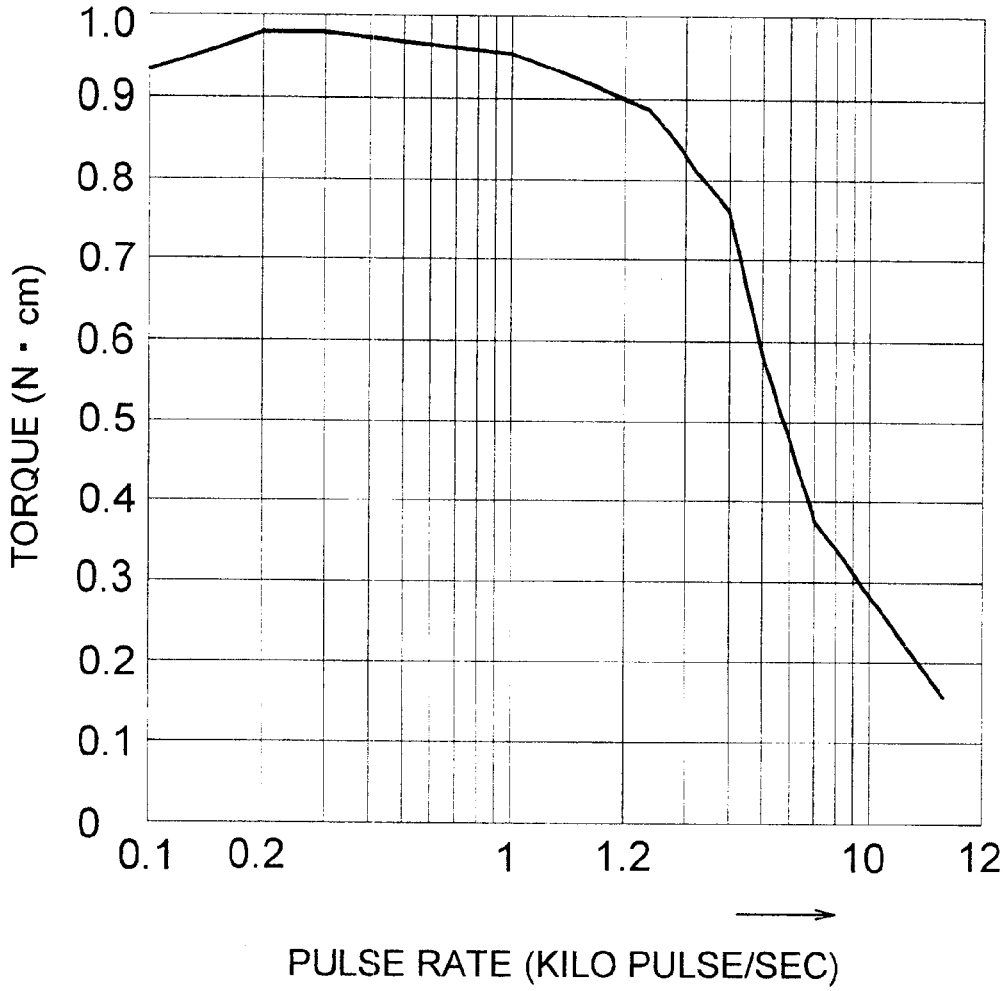
FIG. 11 is a graph showing the relation between the pulse rate (number of revolutions) of a pulse motor and its torque.

In the third means, the sheet folding apparatus B is operated at a normal rated electric voltage, using a power source 155 having a usual size and a pulse motor 158. The characteristic of this pulse motor is shown by a graph representing the relation between the pulse rate (the number of revolutions) and the torque in FIG. 11. During the formation of the fold line "b" in the first folding by means of the roller pair composed of the folding rollers 113 and 114, and during the formation of the fold line "a" in the second folding by means of the roller pair composed of folding rollers 114 and 120, by detecting the timings when the leading edge of a paper sheet passes the above-mentioned roller pairs respectively by the sheet detecting sensors 141 and 142, the input pulse rate to the pulse motor 158 is reduced from a value at the starting and in other normal period by a pulse rate changing means 153 at each of these timings of detection signal. It is provided, as shown in the block diagram of FIG. 8, a control means 140D for practicing a control to obtain firm and stable fold lines "a" and "b" by raising the torque value.

Figure 9:
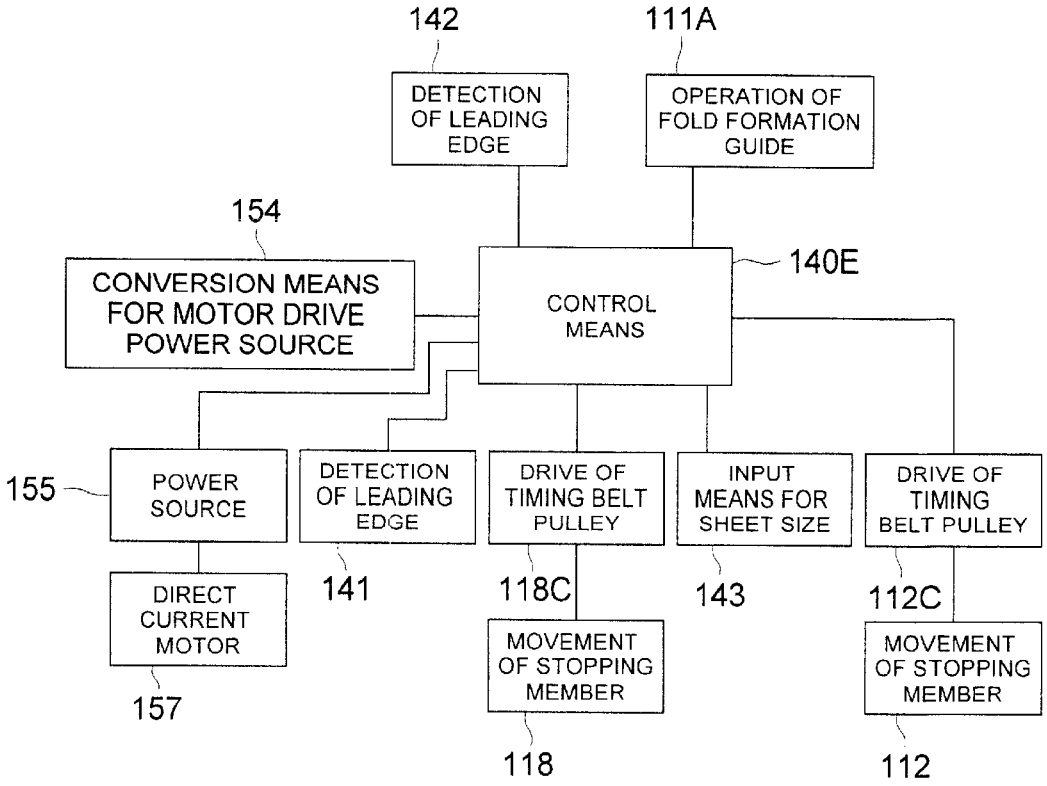
FIG. 9 is further another block diagram of a control means composed of the control means shown in FIG. 4 with a control means for compensating for the load during a sheet folding process added.

Further, in the fourth means, as shown in the block diagram of FIG. 9, by providing a control means 140E for temporarily changing the driving electric power for a motor as a drive means for each of the above-mentioned folding rollers from a specified stationary value to another specified stationary value higher than that by a driving electric power changing means 154 at a timing when a paper sheet is gripped by the above-mentioned roller pair, it is possible to practice a control so as to obtain a firm and stable fold line by raising the torque value.

In addition, each of the block diagrams shown in FIG. 6, FIG. 7, FIG. 8, and FIG. 9 respectively is one for a control means composed of the control means represented by the block diagram shown in FIG. 4 and an additional control means for a torque increasing means.

Further, in the case where folding is not done for a small-sized (A4 for example) sheet and folding is done for a large-sized (A3 for example) sheet to reduce it into A4, to carry out a mixed folding operation, if a paper sheet, which has been introduced into the entrance portion 101, has passed the sheet conveyance path 102, and has been conveyed by the conveyance roller pairs 103 and 104, is directly ejected to the sheet finisher FS outside the sheet folding apparatus B, it collides with a Z-folded paper sheet of, for example, A3 size, which has been conveyed immediately before it, by which the conveyance of the paper sheet is hindered; therefore, in that case, it is practiced such a control that, by switching the switching means 105, the paper sheet of A4 size is made to pass the conveyance path 110A, conveyance rollers 110, the switching gate 111A, and the first and second folding rollers 113 and 114; further, passing through the conveyance paths 115, 116, and 117, the conveyance rollers 123, and the sheet conveyance path 124, the paper sheet is fed from the sheet conveyance path 108 into the sheet finisher FS.

Further, the guide plate 130 forming the one side of the sheet conveyance paths 117 and 122 is made capable of rotary movement around the supporting point 131, the guide plate 135 forming the one side of the sheet conveyance path 110A is made capable of rotary movement around the supporting point 135A, and the guide plate 112A forming the one side of the sheet conveyance path 112 is made capable of rotary movement around the supporting point 112A1; therefore, when a paper jam occurs, by moving round the above-mentioned guide plates, the jammed paper sheet can be easily taken out. However, in such a structure that conveyance paths are arranged in a triple way as a conventional one, in order to dispose of a paper jam phenomenon that has occurred in a conveyance path positioned inside, it is very difficult to recover the apparatus by taking out the jammed paper sheet as long as at least one outside conveyance path is not dismounted, and if all the conveyance paths arranged in a triple way are designed to be capable of being opened, it comes to produce the defect that the apparatus is made large-sized.

By employing a sheet folding apparatus of this invention, it has been actualized that, in folding up a paper sheet having an image formed on it by an image forming apparatus such as a copying machine, without making the motor and the electric power source larger-sized, by taking a measure to increase the torque during only the process of forming a fold line, a firm and stable fold line can be made, and on top of it, the sheet folding apparatus has been made up of a simple and reliable structure, has become efficient without lowering productivity, and has become easy to handle and compact.

By this invention, it has become possible to make a sheet folding apparatus, for a paper sheet having an image formed on it by an image forming apparatus such as a copying machine, have a simple and reliable structure, easy to handle, and small-sized. Further, it has been actualized that an image forming apparatus can simply couple or build inside efficiently a sheet folding function, and also it has been actualized to carry out easily the coupling of it to a sheet finisher which is made to have a binding and editing function.

Figure 12:
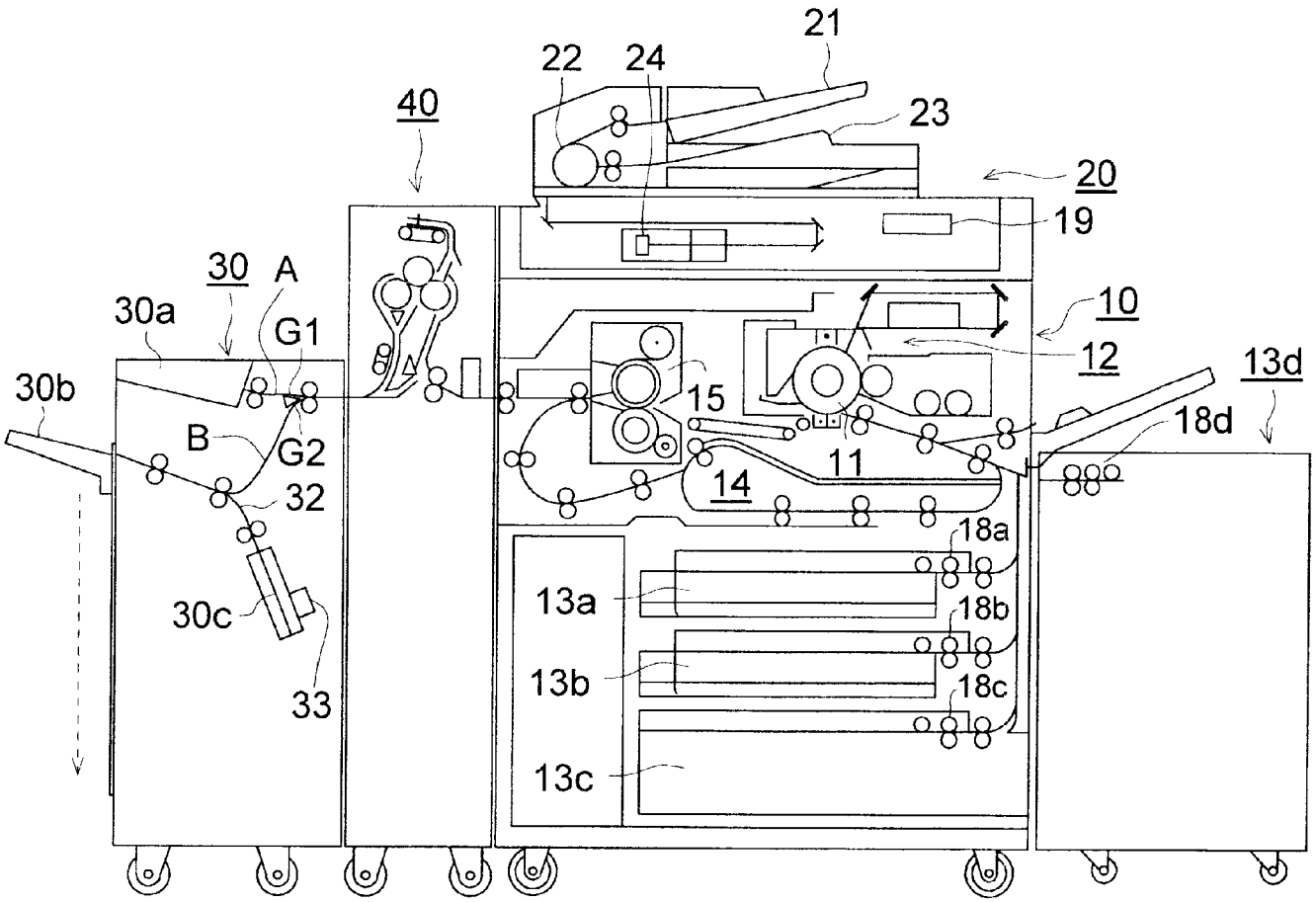
FIG. 12 is a drawing showing the outline of another image forming apparatus of the embodiment of this invention.

In the following, the embodiment for accomplishing the third object of this invention will be explained with reference to the drawings. FIG. 12 is a drawing showing the outline of an image forming apparatus of another example of the embodiment of this invention.

In FIG. 12, numeral 10 denotes an image forming section for forming an image on a paper sheet by an electrophotographic method, 20 denotes an image reading section for outputting image data through reading an image on an document, 40 denotes a sheet folding apparatus as a first finisher, 30 denotes an after-processing section as a second finisher for carrying out after-processing such as stapling for a paper sheet having an image formed in the image forming section 10 and having been conveyed from the sheet folding apparatus.

The image forming section 10 comprises a photoreceptor 11, an image forming unit 12 for forming a toner image through carrying out charging, exposure, and development for the photoreceptor 11 and transferring the toner image formed on the photoreceptor 11 onto a paper sheet, sheet containing sections 13*a*, 13*b*, 13*c*, and 13*d* for containing paper sheets of various sizes separately for the respective sizes, sheet feeding sections 18*a*, 18*b*, 18*c*, and 18*d* provided with the respective groups of rollers for taking out paper sheets one by one from the respective sheet containing sections 13*a*, 13*b*, 13*c*, and 13*d* to convey them to the image forming unit 12, a sheet inverting feeding section 14 for inverting and conveying a paper sheet having an image recorded on its one side to the image forming unit 12 in the case of duplex image formation, and a fixing device 15 for fixing a toner image transferred onto a paper sheet.

The image reading section 20 comprises a document feeding table 21, a platen roller 22 for conveying a document sheet and forming a reading site, document ejection table 23 for placing a document after reading, an image sensor 24 for receiving a image light reflected from a document and generating a reading signal.

In the after-processing section 30, there are provided a fixed exit tray 30*a*, to which a paper sheet is ejected as it is, and a movable exit tray 30*b*, and further, a sheet ejection path A for ejecting a paper sheet onto the fixed exit tray 30*a*, a sheet ejection path B for ejecting a paper sheet to the movable exit tray 30*b* of a moving up-and-down type to be used in cases where a number of sheets are ejected, and a gate G1 for switching the conveyance paths to guide a paper sheet to one of these paths. To the sheet ejection path B, further, a sheet conveyance path 30*c* for a stapler 33 is connected.

Next, the structure of the sheet folding apparatus 40 in this embodiment will be explained.

Figure 13:
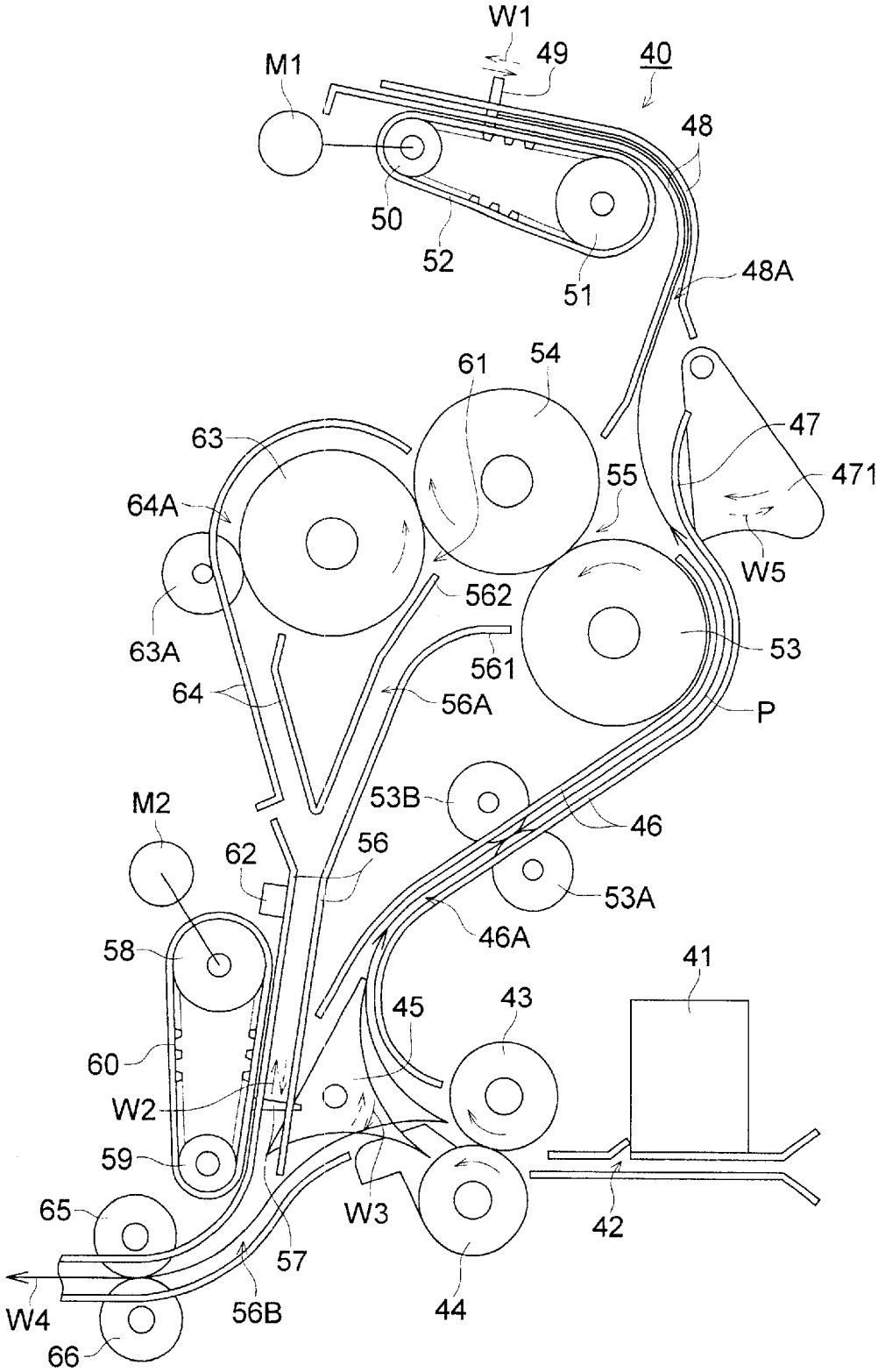
FIG. 13 is a drawing showing the structure of a sheet folding apparatus.

As shown in FIG. 13, in the conveyance path 42 forming an entrance portion to the sheet folding apparatus 40, there is provided a punching device 41, and at the downstream side of the conveyance path 42, conveyance rollers 43 and 44 are provided. Further, in the first conveyance path 46A, which is formed by guide plates 46, intermediate conveyance rollers 53A and 53B and a switching member 45 for switching conveying directions are provided, and at the exit portion of the first conveyance path 46A, a sheet guide portion 47 forming the rear end portion of one of the guide plates 46 is formed.

Further, at a position opposite to a sheet guide portion 47, a pair of folding rollers 53 and 54 are provided in pressing contact with each other, and further, in pressing contact with the folding roller 54, a folding roller 63 is provided. The folding rollers 53, 54, and 63 are made of a material having a high resistivity against friction such as rubber. At the upstream side of the folding rollers 53 and 54, a second conveyance path 48A is formed of a pair of guide plates 48. In the second conveyance path 48A, a first stopping member 49 for stopping the leading edge of a paper sheet P is provided movably in the direction W1, which is the moving direction of a paper sheet P. On the other hand, under the guide plate 48, toothed pulleys 50 and 51 are provided, and around the toothed pulleys 50 and 51, a toothed belt 52 is stretched; further, the base portion of the above-mentioned stopping member is fixed to the toothed belt 52. In order to move the first stopping member 49 in the direction W1, a stepping motor M1 for driving the toothed pulley 50 is provided, and by rotating the toothed pulley 50, the first stopping member 49 is moved and stopped at a specified position. The first stopping member 49 is driven by the stepping motor M1, and moves to stop at a position selected out of a plurality of specified positions in accordance with the size of the specified paper sheet P to be processed.

Figure 18:
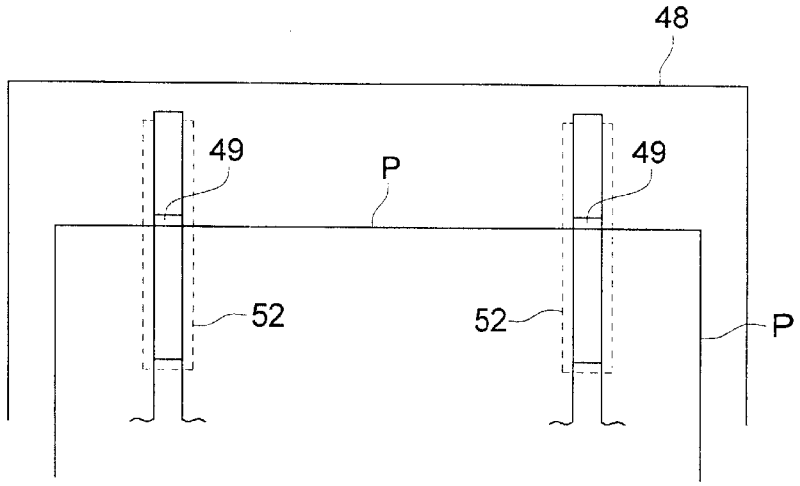
FIG. 18 is a drawing showing the arrangement of a pair of first stopping members.

As shown in FIG. 18, by providing the toothed belt 52 and the first stopping member 49 at each of the two positions in the width direction of the conveyance path, the leading edge of a paper sheet P is kept perpendicular to its moving direction; therefore, the paper sheet P can be precisely folded up.

The folding rollers 53 and 54, the first stopping members 49, the toothed belts 52, and the stepping motor M1 forms a first sheet folding portion.

Further, in the downstream side of the folding rollers 54 and 63 with respect to the conveying direction, there is provided a third conveyance path 56A formed of a pair of guide plates 56. At the upper portion of the guide plates 56, a curved guide portion 561 and a guide end portion 562 are formed. On the other hand, in the same way as the first stopping members 49, in the third conveyance path 56A, a second stopping member 57 is provided movably in the moving direction W2 of a paper sheet P. Further, toothed pulleys 58 and 59 are provided at the left side of the lower portion of the guide plates 56, a toothed belt 60 is stretched around the toothed pulleys 58 and 59, and the base portion of the above-mentioned second stopping member 57 is fixed to the toothed belt 60. In order to move the second stopping members 57 in the direction W2, which is the sheet conveyance direction, a stepping motor M2 for driving the toothed pulley 58 is provided, and by driving the toothed pulley 58, the stopping member 57 is moved together with the toothed pulley 60 in the direction W2 to be stopped at a specified position.

Therefore, the leading edge of a paper sheet P to be folded and conveyed by the folding rollers 53 and 54 collides with the stopping member 57, and the portion of the paper sheet P positioned near the guide portion 561 is buckled, to be drawn by the folding rollers 54 and 63 between them to have the second fold P2 formed. Further, in the downstream side of the folding rollers 54 and 63, there are provided a pair of guide plates 64, of which a fourth conveyance path 64A is formed. Owing to the guide plates 64 and driven roller 63A being pressed to the folding roller 63, the conveyance of a paper sheet P in the fourth conveyance path 64A is made to be of high reliability. The fourth conveyance path 64A is extended to the position of the second stopping member 57, to lead to a sheet ejection path 56B. In the sheet ejection path 56B, sheet ejection rollers 65 and 66 are provided.

The folding rollers 54 and 63, the second stopping members 57, the toothed belt 60, and the stepping motor M2 forms a second sheet folding portion.

Further, a sensor 62 for detecting a paper sheet P is provided at the joint portion of the third conveyance path 56*a* and the fourth conveyance path 64A, and detects the passage of a paper sheet P in the third conveyance path 56A.

In addition, as shown in FIG. 13, at the right side of the sheet guide portion 47, a movable auxiliary guide member 471 (its function is to be described later) is provided.

The action of the sheet folding apparatus 40 having the above-mentioned structure, that is, the folding process to carry out folding in two and folding in three will be explained.

(1) Simple Sheet Feeding

Simple sheet feeding will be explained on the basis of FIG. 13 and FIG. 14. From the state shown in FIG. 13, a switching member 45 provided in the sheet folding apparatus 40 is rotated to the direction W3 (dotted line). A paper sheet P is conveyed through the conveyance path 42 by the conveyance rollers 43 and 44, is guided to the sheet ejection path 56B by the switching member 45, and is conveyed in the direction W4 by the sheet ejection rollers 65 and 66, to be fed to the after-processing section 30.

In the case where boring processing is applied to the paper sheet P, the paper sheet P in the conveyance path 42 is stopped at a timing when the paper sheet P has been conveyed up to a specified length by the conveyance rollers 43 and 44, and the sheet ejection rollers 65 and 66, and after punching operation is conducted at specified positions of the paper sheet P by a punching device 41, the paper sheet P is again conveyed by the conveyance rollers 43 and 44, and the sheet ejection rollers 65 and 66, to be fed to the after-processing section 30.

Figure 14:
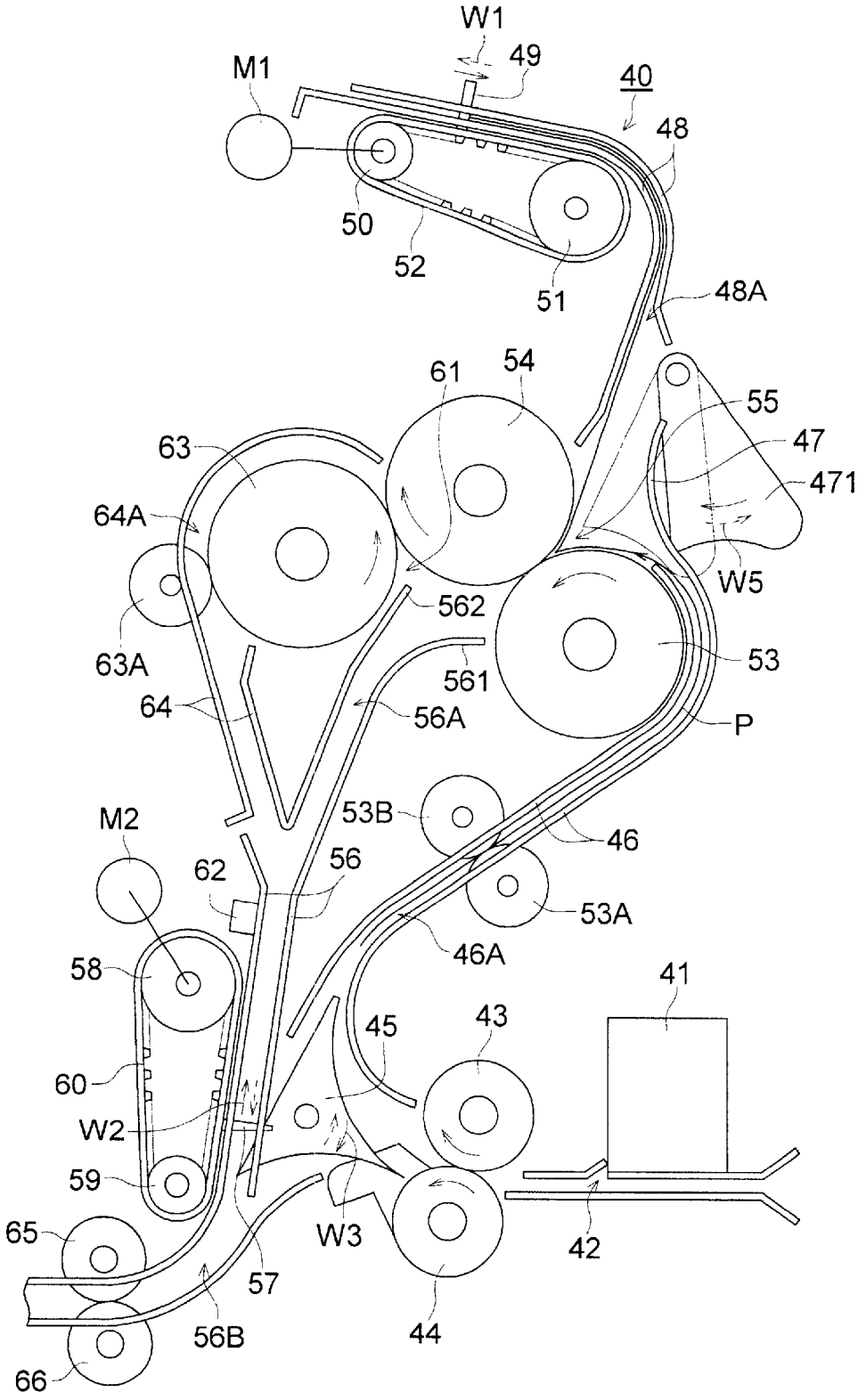
FIG. 14 is a drawing for explaining the formation of the first fold portion.
Figure 16:
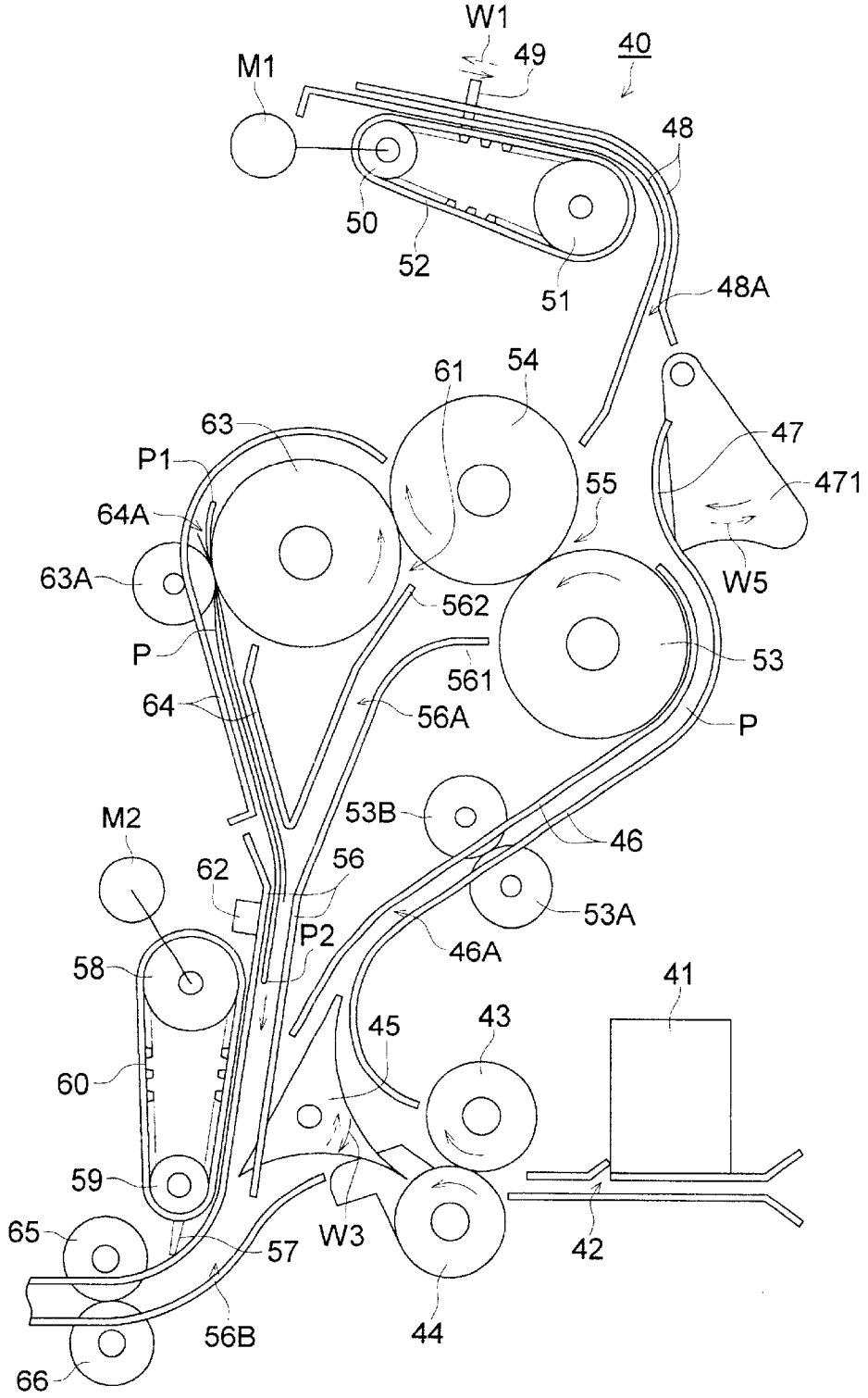
FIG. 16 is a drawing for explaining the conveyance of a paper sheet after the formation of the second fold portion.

Further, in the case where holes are bored at the rear end portion of a long paper sheet P, first, the switching member 45 is rotated to the direction W3 (solid line), while the movable auxiliary guide member 471 is rotated in the direction W5 (solid line), to establish a state where the second conveyance path 48A is closed as shown by the single dot and dash line in FIG. 14. After such a conveyance path has been formed, the paper sheet P is conveyed by the conveyance rollers 43 and 44. First, the paper sheet P is conveyed through the first conveyance path 46A, is conveyed by the intermediate conveyance rollers 53A and 53B to be guided by the movable auxiliary guide member 471, and further, is introduced from the sheet entrance site 55 between the folding rollers 53 and 54 by their rotating in the respective directions shown by the arrow marks. In a mode in which holes are bored at the rear end portion of a paper sheet, the stepping motor M2 is operated to drive the toothed belt 60, and the second stopping member 57 is moved to the position shown in FIG. 16 to be retracted from the sheet ejection path 56B. At the timing when the trailing edge of the paper sheet P, which is being conveyed through the third conveyance path 56A and the sheet ejection path 56B, reaches the punching device 41, the folding rollers 53 and 54, the conveyance rollers 43 and 44, and the intermediate conveyance rollers 53A and 53B are stopped, and the punching device 41 is made to operate to apply boring processing at specified positions of the paper sheet P; after that, the paper sheet P is again conveyed by the rotation of these rollers, and is fed to the after-processing section 30 by the sheet ejection rollers 65 and 66.

(2) Fold Processing

The action in fold processing will be explained on the basis of FIG. 13 to FIG. 16. A paper sheet is conveyed in such a way as to move from a state shown in FIG. 14 to another state shown in FIG. 15, and further from one shown in FIG. 15 to another shown in FIG. 16.

By setting a folding mode and a paper sheet size, first in FIG. 13, in accordance with the size information of a paper sheet P, the stepping motors M1 and M2 are driven by a control means (not shown in the drawing) to drive the toothed belts 52 and 60, to move the first stopping members 49 and the second stopping members 57 to the respective positions corresponding to the size; further, by the rotation of the switching member 45 to the direction W3 (solid line), the sheet ejection path 56B is closed.

By the starting of the folding process, the paper sheet P, which has been fed from the image forming section 10, is conveyed through the first conveyance path 46A by the conveyance rollers 43 and 44 and the intermediate conveyance rollers 53A and 53B, next, enters the second conveyance path 48A, and the leading edge of the paper sheet P collides against the first stopping members 49 (refer to FIG. 13 and FIG. 18).

Subsequently, as shown in FIG. 14, the intermediate conveyance rollers 53A and 53B continue to rotate, to convey forcibly the paper sheet P towards the direction of the first stopping members 49. However, because the leading edge of the paper sheet P is kept stopped, a bending force acts on the paper sheet P between the first conveyance path 46A and the second conveyance path 48A; however, because the sheet guide portion 47 is formed at the right side, it is bent towards the folding rollers 53 and 54, and the buckle portion of the sheet paper P enters the entrance site formed between the folding rollers 53 and 54. Further, because the folding rollers 53 and 54 rotate in the directions shown by the arrow marks respectively, the paper sheet P is conveyed as the first fold portion P is being formed.

Figure 15:
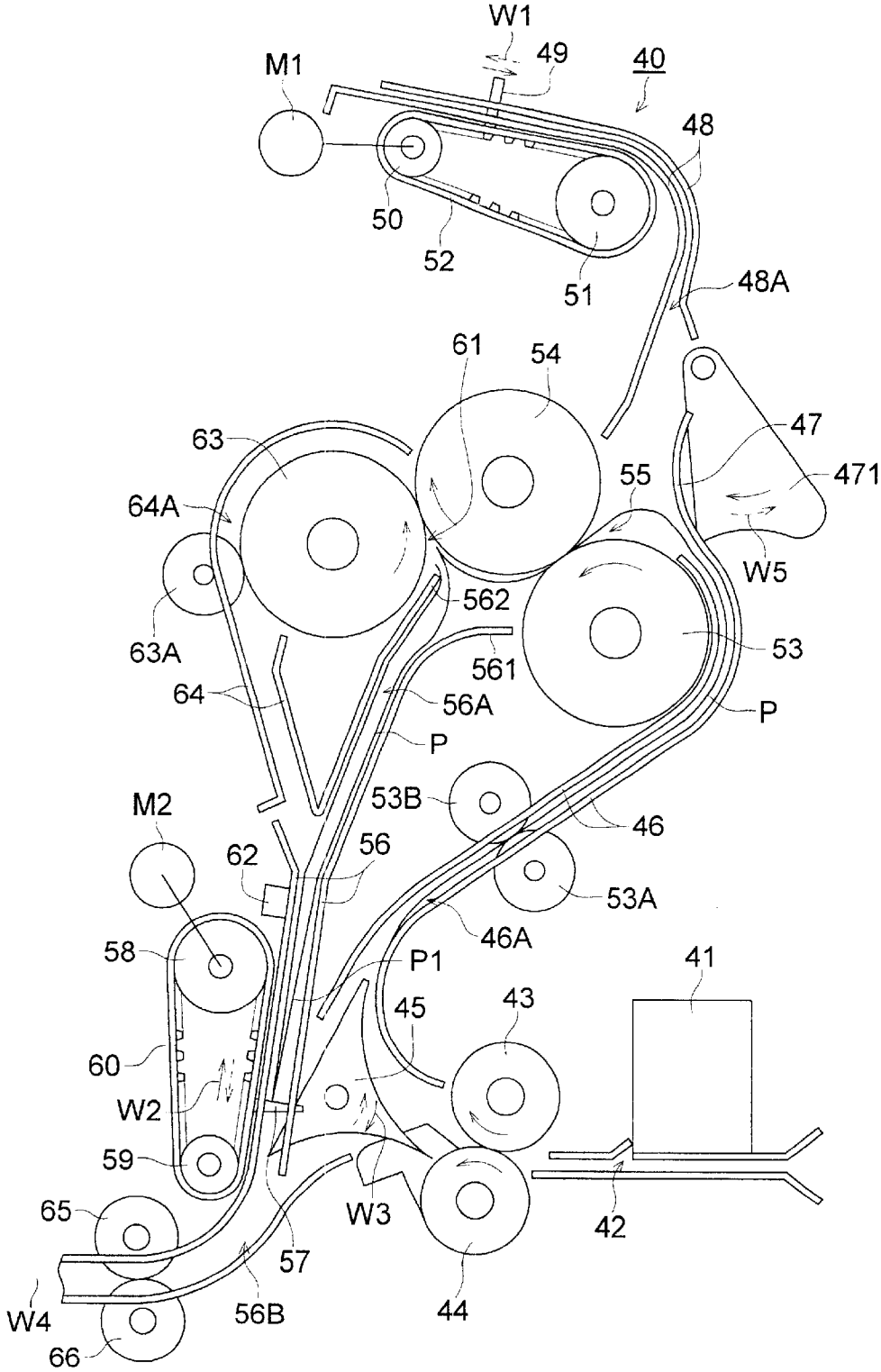
FIG. 15 is a drawing for explaining the formation of the second fold portion.

Next, as shown in FIG. 15, the paper sheet P, which has the first fold portion P1 formed, is conveyed through the third conveyance path with the fold portion P1 made the leading edge. Then, the first fold portion P1 collides against the second stopping member 57 to be stopped. Further, because the folding rollers 53 and 54 continue to rotate, a bending force acts on the paper sheet P between the folding roller pair 53 and 54 and the third conveyance path 56A, but as the result of it that its bending towards the downward direction is prevented by the rear end portion 561 of one of the guide plates 56, the paper sheet P enters the entrance site 61 formed between the folding rollers 54 and 63.

Because the folding rollers 54 and 63 rotate in the directions shown by the arrow marks respectively, the buckle portion of the paper sheet P is introduced into the area between the folding rollers 54 and 63, and the paper sheet P is conveyed as the second fold portion P2 is being formed.

The paper sheet P, which has the first fold portion P1 and the second fold portion P2 formed, moves upward through the third conveyance path 56A by the conveying action of the folding rollers 54 and 63, and the first fold portion P1 leaves the second stopping member 57. Then, by the detection signal obtained by the sensor 62 having detected the passage of the first fold portion P1, the stepping motor M2 is driven. By the action of the stepping motor M2, the second stopping member 57 is moved to the position shown in FIG. 16, to be retracted from the sheet ejection path 56B.

Figure 17:
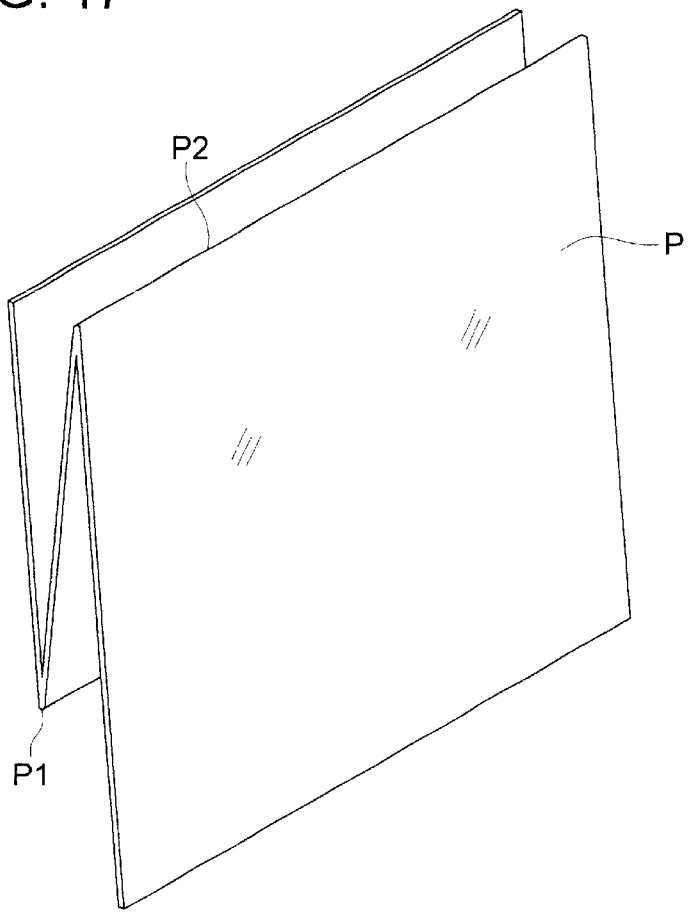
FIG. 17 is a drawing showing a paper sheet having been folded in three (Z-folded)

The paper sheet P, which has been subjected to processing of folding in three as shown in FIG. 17, is conveyed along the folding roller 63 by the guide plates 64 and the driven roller 63A, and runs through the fourth conveyance path downward. Next, after it has passed the third conveyance path 56A, it is fed to the after-processing section 30 by the sheet ejection rollers 65 and 66 in the sheet ejection path 56B with the second fold portion P2 made the leading edge.

Up to now, fold processing to fold a paper sheet P in three has been explained. In fold processing to fold a paper sheet in two, first, fold processing is carried out by the folding rollers 53 and 54, in a state where the first stopping members 49 are moved to the position for folding in two and the second stopping member 57 is retracted to the position shown in FIG. 5; after that, the paper sheet P is ejected from the third conveyance path 56A through the sheet ejection path 56B to the after-processing section 30.

According to the structure (8) or (9), because a stopping member for folding a paper sheet is displaced by means of a toothed belt, the displacement of a paper sheet in accordance with the paper size is enabled without requiring a large space. By this structure, it is actualized at a low cost a small-sized sheet folding apparatus capable of coping with the variation of sheet size.

According to the structure (10), because the leading edge of a paper sheet is stopped by using the stopping function of a stepping motor, a function to displace a stopping member and a function to stop a paper sheet are simultaneously actualized by means of a simple mechanism.

According to the structure (11), a small-sized sheet folding apparatus can be actualized.

According to the structure (12), because a structure to support a stopper member by a belt is employed, the mechanism to retract the stopper member from a sheet conveyance path is made extremely small-sized; this makes it possible to make a sheet folding apparatus have multiple functions, and a small-sized sheet folding apparatus can be actualized.

According to the structure (13), because a stopping member for sheet folding is displaced by means of a toothed belt, the displacement of a stopping member in accordance with the paper sheet size is enabled without requiring a large space. By employing this structure, a small-sized image forming apparatus equipped with a small-sized sheet folding apparatus capable of coping with the variation of sheet size can be actualized.

According to the structure (14) or (16), a small-sized image forming apparatus equipped with a finisher comprising a sheet folding apparatus and a finisher comprising a stapler etc. can be actualized.

According to the structure (15), an image forming apparatus equipped with a finisher, which comprises a sheet folding apparatus and has a boring means built in, can be formed in a small size.

What is claimed is:

1. A sheet folding apparatus comprising:

(a) a sheet conveyor for conveying a sheet on which an image has been formed;

(b) a stopper provided in a conveyance path of the sheet conveyed by the sheet conveyor for coming into contact with a leading edge of the sheet thereby stopping the sheet, the stopper being movable in a conveyance direction of the sheet for adjusting a position thereof;

(c) a paired twofold rollers driven by a same motor for folding in two the sheet with a buckle caused by the stopper, by interposing the sheet between the paired twofold rollers; and d) a controller for making a peripheral speed of the paired twofold rollers immediately before the paired twofold rollers receive the sheet to be temporarily lowered than a conveyance speed of the sheet when the sheet folding apparatus receives the sheet.

2. The sheet folding apparatus of claim 1, wherein the controller makes the peripheral speed of the paired twofold rollers to be temporarily lowered when the paired twofold rollers receive the sheet, by switching a deceleration mechanism directly connected to said motor using a clutch while the number of revolution of the motor is kept constant.

3. The sheet folding apparatus of claim 1, wherein the controller makes a drive current of a direct current motor for serving to drive the paired twofold rollers to be temporarily increased when the paired twofold rollers receive the sheet.

4. The sheet folding apparatus of claim 1, wherein the controller makes a pulse rate of a pulse motor for serving to drive the paired twofold rollers to be temporarily increased when the paired twofold rollers receive the sheet.

5. The sheet folding apparatus of claim 1, wherein the controller makes electric drive power of a driver to be temporarily changed from a first regular valve to a second regular valve higher than the first regular valve when the paired twofold rollers receive the sheet.

6. The sheet folding apparatus of claim 1, further comprising:

a second conveyance path through which a leading edge of the sheet which has been twice-folded and conveyed by the paired twofold rollers passes; and a sheet ejection path through which the sheet that has been folded in three passes, wherein the second conveyance path and the sheet ejection path are the same path.

7. The sheet folding apparatus of claim 1, further comprising:

a second conveyance path through which a leading edge of the sheet which has been twice-folded and conveyed by the paired twofold rollers passes;

a second stopper provided in the second conveyance path for stopping the sheet which has been twice-folded;

a second paired twofold rollers for folding in three the twice-folded sheet with a buckle caused by the second stopper, by interposing the sheet between the second paired twofold rollers; and a detector provided between the second conveyance path and the second paired twofold rollers for detecting forward movement and backward movement of the sheet, wherein the controller makes the second stopper to be retreated from the second conveyance path and the sheet folded in three to be ejected on the basis of information detected by the detector.

8. The sheet folding apparatus of claim 1, further comprising:

a toothed belt for holding the stopper; and a belt moving device for moving the toothed belt, wherein the belt moving device stops the stopper at a position selected from plural predetermined positions.

9. The sheet folding apparatus of claim 8, wherein the toothed belt is an endless belt.

10. The sheet folding apparatus of claim 8, wherein the belt moving device is a stepping motor.

11. The sheet folding apparatus of claim 8, wherein comprising two sets of the stopper, the toothed belt and the belt moving device.

12. The sheet folding apparatus of claim 8, wherein the belt moving device moves the stopper to a retreated position.

* * * * *